US009644307B2

(12) United States Patent
Da Pont et al.

(10) Patent No.: US 9,644,307 B2
(45) Date of Patent: May 9, 2017

(54) DRAWER STRUCTURE FOR DISPENSING METERED AMOUNTS OF WASHING AGENT IN A WASHING MACHINE

(71) Applicant: Elbi International S.p.A., Turin (IT)

(72) Inventors: Paolo Da Pont, Turin (IT); Luca Garetto, Turin (IT); Paolo Ravedati, Turin (IT)

(73) Assignee: ELBI INTERNATIONAL SPA, Turin (IT)

( * ) Notice: Subject to any disclaimer, the term of this patent is extended or adjusted under 35 U.S.C. 154(b) by 0 days.

(21) Appl. No.: 14/910,211

(22) PCT Filed: Aug. 11, 2014

(86) PCT No.: PCT/IB2014/063849
§ 371 (c)(1),
(2) Date: Feb. 4, 2016

(87) PCT Pub. No.: WO2015/022622
PCT Pub. Date: Feb. 19, 2015

(65) Prior Publication Data

US 2016/0177491 A1 Jun. 23, 2016

(30) Foreign Application Priority Data

Aug. 14, 2013 (IT) ..... TO2013A0693

(51) Int. Cl.
*D06F 39/02* (2006.01)

(52) U.S. Cl.
CPC ..... *D06F 39/02* (2013.01); *D06F 39/022* (2013.01)

(58) Field of Classification Search
CPC ..... D06F 39/02; D06F 39/022
See application file for complete search history.

(56) References Cited

U.S. PATENT DOCUMENTS 8,171,757 B2 5/2012 Dahlke
2005/0284194 A1* 12/2005 Kim ..... D06F 39/081 68/17 R (Continued)

FOREIGN PATENT DOCUMENTS

DE 3704080 A1 8/1988
DE 10-2007-050920 B3 12/2008

(Continued)

OTHER PUBLICATIONS

International Search Report and Written Opinion for International Publication No. PCT/IB2014/063849, mailed Nov. 13, 2014.

(Continued)

*Primary Examiner* — Joseph L Perrin
(74) *Attorney, Agent, or Firm* — Merchant & Gould P.C.

(57) ABSTRACT

A structure has a drawer defining at least one chamber receiving a washing agent and is mounted to move in a shell between an extracted position, in which the chamber is accessible from the outside for receiving a washing agent, and a retracted position, in which the chamber is closed by the shell and suited to dispense the washing agent. A passage communicates with the chamber and outside. A pumping member is suited to push a quantity of washing agent from the chamber towards the passage. An actuator operates the pumping member and is fixed on the shell separate from the drawer. The pumping member is able to assume an active condition, coupled to the actuator and to the passage, when the drawer is retracted. The pumping member is able to assume an inactive condition, uncoupled from the actuator or from the passage, when the drawer is extracted.

13 Claims, 7 Drawing Sheets

(56) References Cited

U.S. PATENT DOCUMENTS

| | | | | |
|---|---|---|---|---|
| 2009/0100881 | A1* | 4/2009 | Dahlke | D06F 39/022 68/17 R |
| 2010/0000025 | A1* | 1/2010 | Dalton | D06F 39/02 8/137 |
| 2010/0000264 | A1 | 1/2010 | Luckman et al. | |
| 2012/0096901 | A1* | 4/2012 | Zattin | D06F 39/02 68/13 R |
| 2012/0159997 | A1* | 6/2012 | Del Pos | D06F 39/022 68/13 R |
| 2012/0180533 | A1* | 7/2012 | Song | D06F 39/02 68/17 R |

FOREIGN PATENT DOCUMENTS

| | | | |
|---|---|---|---|
| DE | 10-2009-030329 | A1 | 1/2010 |
| EP | 2251480 | A1 | 11/2010 |
| EP | 2251481 | A1 | 11/2010 |
| EP | 2476792 | A2 | 7/2012 |

OTHER PUBLICATIONS

International Preliminary Report on Patentability for International Publication No. PCT/IB2014/063849, mailed Oct. 16, 2015.

* cited by examiner

Fig.3
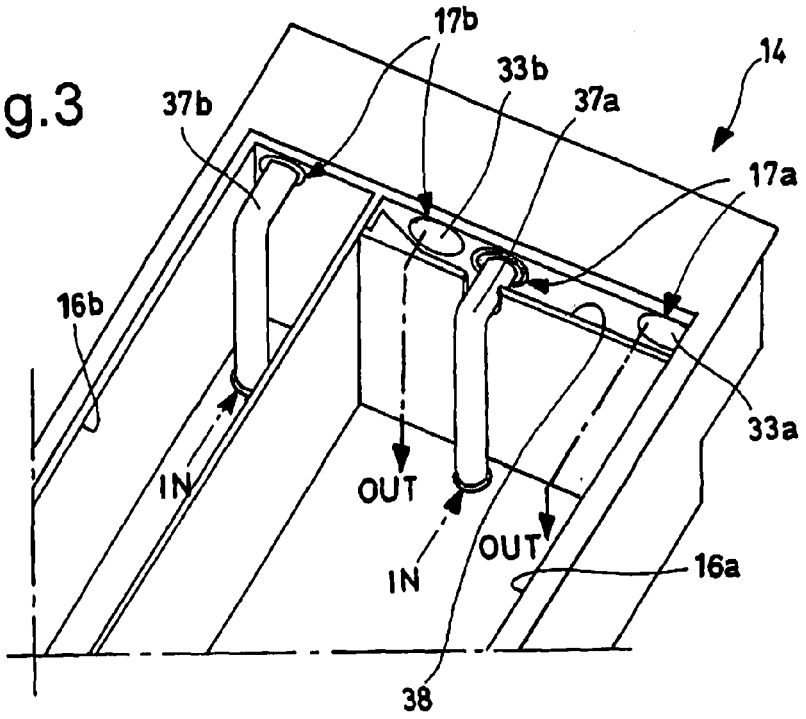
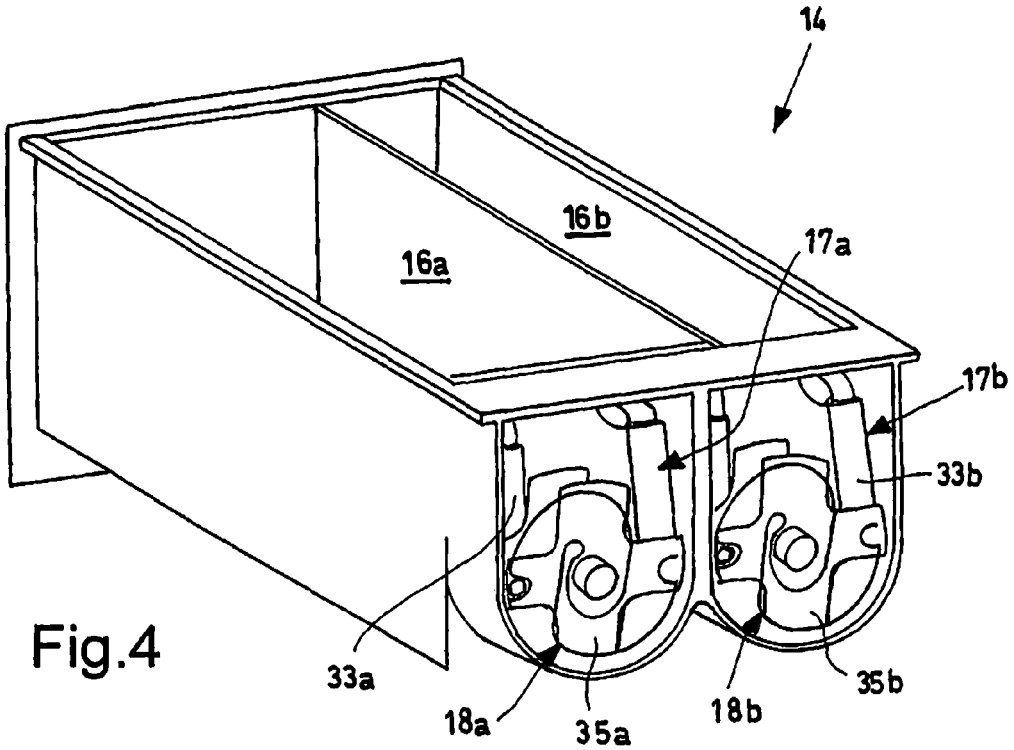
Fig.4

Fig.11
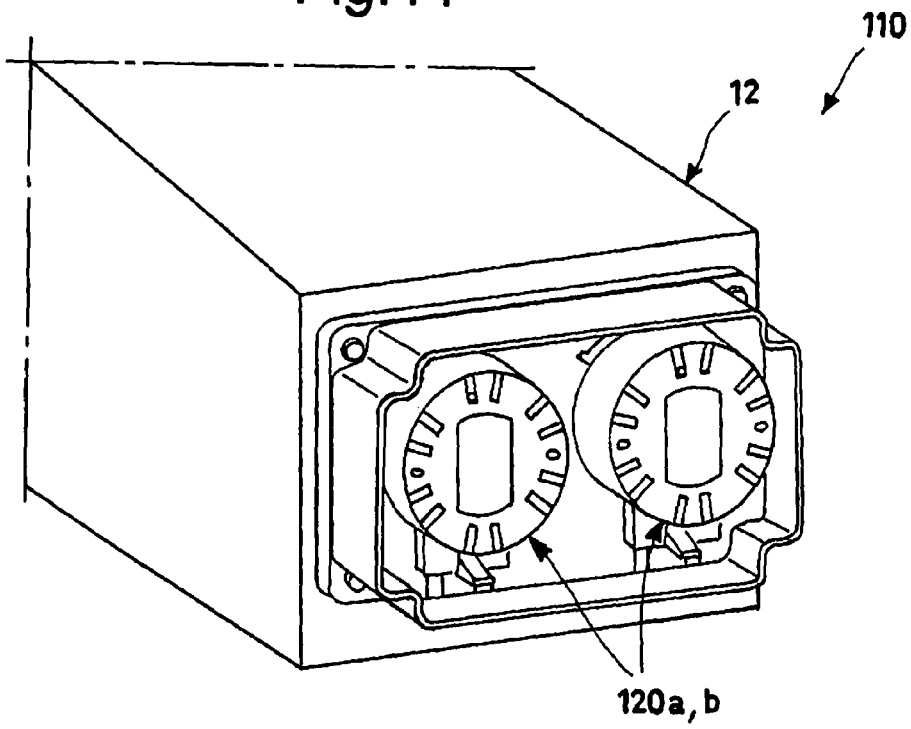
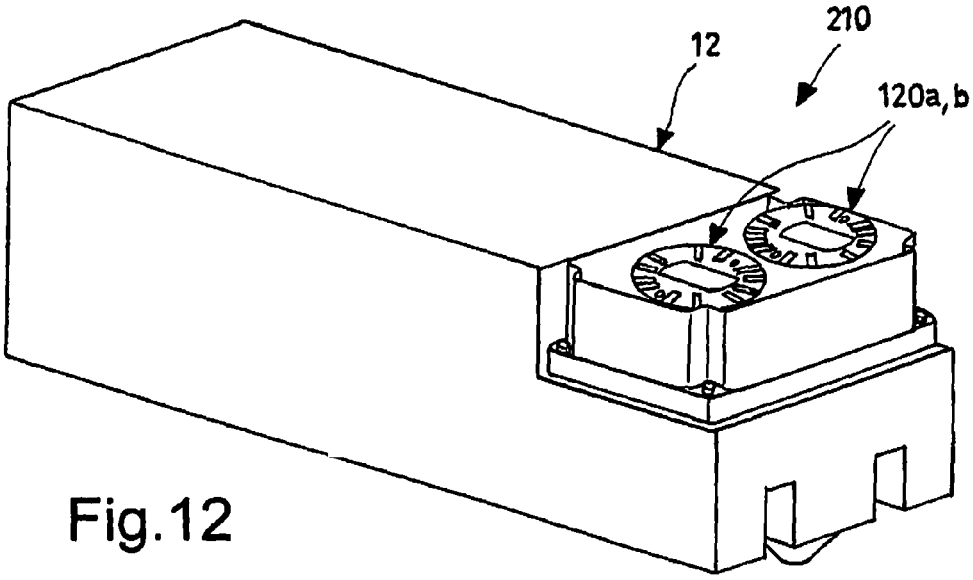
Fig.12

DRAWER STRUCTURE FOR DISPENSING METERED AMOUNTS OF WASHING AGENT IN A WASHING MACHINE

This application is a National Stage Application of International Application No. PCT/M2014/063849, filed 11 Aug. 2014, which claims benefit of Serial No. TO2013A000693, filed 14 Aug. 2013 in Italy and which applications are incorporated herein by reference. To the extent appropriate, a claim of priority is made to each of the above disclosed applications.

TECHNICAL FIELD

The present invention relates to a structure for dispensing metered amounts of at least one washing agent in a washing machine, in particular a laundry washing machine.

TECHNOLOGICAL BACKGROUND

In the technical field of washing machines—and in particular in the technical field of laundry washing machines—the use of drawer structures is widely known, which are adapted to contain one or more washing agents, typically a laundry detergent and a softener, which are suited to be dispensed in a metered manner according to operating modes that are predetermined during a work cycle of the machine itself.

More in detail, these structures comprise a hollow shell, in which a drawer is mounted in a movable manner and defines one or more chambers, which are each adapted to act as a tank that is suited to receive the washing agent (laundry detergent or softener), typically in a quantity that is equal to a plurality of doses of said washing agent. Furthermore, the shell containing the drawer is generally mounted on a casing of the laundry machine, so as to be movable between an extracted position and a retracted position relative to the casing. In the extracted position, the chambers of the drawer open up outwards and are adapted to receive said quantity of laundry detergent and/or softener. In the retracted position, on the other hand, the chambers of the drawer are closed by the casing and are suited to dispense the aforesaid quantity of laundry detergent and/or softener during the work cycle through inner ducts of the machine towards the washing tank.

For this type of application, the washing agents used are typically available in a liquid form and, therefore, they are generally dispensed by means of a pumping apparatus, in particular of the hydraulic type. The pumping apparatus usually comprises a pair of electropumps, of which one is adapted to push a quantity of the liquid contained in the laundry detergent chamber, whereas the other one, in turn, is adapted to push a quantity of the liquid contained in the softener chamber. In use, these quantities are equal to the respective doses desired for the work cycle selected, whereas the remaining part of the laundry detergent and softener in the liquid form remains in the respective chambers so as to be used in following work cycles.

The pumping apparatus is generally controlled by an electronic control unit, which is arranged in the washing machine and is configured to be electrically connected to the electropumps so as to cause the laundry detergent and softener to be dispensed according to predetermined operating modes.

According to the prior art, an example of drawer is known, in which the electropumps are mounted inside the chambers and are electrically connected to the electronic control unit by means of a mechanical connection, which is interrupted every time the drawer is moved from the retracted position to the extracted position. Typically, this electric connection is performed by means electric connectors, which have a part that is mounted on the drawer, whereas the other part is mounted on the casing, these parts being able to be engaged and disengaged every time the drawer is moved to the retracted position and removed from the retracted position, respectively.

Though, the aforesaid example has some drawbacks.

One drawback is due to the fact that the electropumps are operatively immersed in the respective washing agents in the liquid form that are housed in the chambers.

This drawback implies not only a remarkable reduction of the liquid loading capacity inside the chambers. In fact, for reasons due to electric safety, manufacturers necessarily have to use an electropump provided with a DC and low-power electric motor, thus making the adoption of a power supplier indispensable, which causes the system to be more complicated. Furthermore, the electric wiring must be performed with expensive solutions, so as to ensure the reliability of the electric connection.

Another drawback is due to the fact that the electric connection is reversible and removable, in particular by means of electric connectors. In fact, the drawer, in use, is frequently moved to the retracted position and removed from it, thus involving a considerable risk that, in time, can lead to the electric connectors being affected by wear, which causes the electric connection between the electropumps and the control unit to be unreliable. This can cause serious faults and failures of the laundry machine.

Also, in the art are known some devices or methods as described in their respective documents.

For example, EP 2251481 A1 discloses a laundry washing appliance comprising a cabinet accommodating a laundry washing tub and a dispensing arrangement for dispensing laundry washing treatment products to be used during laundry washing, the dispensing arrangement comprising: a drawer slidable within a seat provided in the cabinet, the drawer defining at least one container for laundry washing treatment products; at least one suction pump associated with the at least one container and fluidly connected to the laundry washing tub for delivering thereto dosed amounts of the treatment products; suction pipes connected between the at least one suction pump and the at least one container, wherein the at least one suction pump and the suction pipes are arranged so as to enable the suction of the dosed amounts of treatment product from above a surface of the treatment product contained in said container.

EP 2251480 A1 discloses a laundry washing appliance comprising a cabinet accommodating a laundry washing tub and a dispensing arrangement for dispensing laundry washing treatment products to be used during laundry washing. The dispensing arrangement comprises: a drawer slidable within a seat provided in the cabinet, the drawer defining at least one container for laundry washing treatment products; at least one suction pump associated with the at least one container and fluidly connected to the laundry washing tub for delivering thereto dosed amounts of the treatment products; at least one valve for fluidly connecting the at least one container to the at least one suction pump, the valve being realized so as to automatically close and cut off the fluid connection between the at least one container and the at least one suction pump when the drawer is even partially extracted from the seat, and to automatically open and establish the fluid connection between the at least one container and the at least one suction pump when the drawer is pushed into the seat.

DE 102009030329 A1 discloses a method of converting a household cleaning appliance having a single use dispensing system to a bulk dispensing system, wherein the single use dispensing system comprises a dispenser housing in a cabinet of the household cleaning appliance and is fluidly coupled to a treating chamber in the cabinet, and at least one dispensing cup fluidly coupled to the dispenser housing, the method comprising: inserting a bulk dispensing cartridge having a fluid outlet into the at least one dispensing cup; and mounting a metering device with a fluid inlet and a fluid outlet in the cabinet such that the metering device fluid outlet is fluidly coupled to the housing and the metering device fluid inlet mates with the bulk dispensing cartridge fluid outlet when the drawer is in a dispense position thereby establishing a bulk dispensing flow path from the bulk dispensing cartridge to the housing.

SUMMARY OF THE INVENTION

An object of the present invention is to provide a drawer structure, which is able to ensure a safe and reliable electric connection between the electric motor and the electronic control unit. In particular, thanks to the present invention, this safety in the insulation of the electric connection enables the use not only of DC electropumps, but also of AC (for example 230 V) electropumps.

A further object of the present invention is to provide a drawer structure, which is able to ensure designing flexibility, especially by permitting the adoption of different building layouts of the pumping apparatus.

An additional object of the present invention is to provide a drawer structure, whose possibilities of mechanical connection to the casing and control unit are ergonomic.

According to the present invention, these and other objects are reached by means of a drawer structures having the features described herein.

The technical teachings provided in the following detailed description concerning the present invention define some preferred embodiments of the present invention and describe optional technical features.

BRIEF DESCRIPTION OF THE DRAWINGS

Further features and advantages of the present invention will be best understood upon perusal of the following detailed description, which is provided by way of example and is not limiting, with reference, in particular, to the accompanying drawings, wherein:

FIG. 3 is a partial perspective view seen from above of a drawer of the structure shown in the previous figures;

FIG. 4 is a rear perspective view of the drawer shown in FIG. 3;

FIG. 11 is a rear perspective view of a shell of a drawer structure manufactured according to a further exemplary embodiment of the present invention;

FIG. 12 is a rear perspective view of a shell of a drawer structure manufactured according to another embodiment of the present invention;

DETAILED DESCRIPTION OF THE INVENTION

With reference to the figures from 1 to 9, number 10 indicates, as a whole, a drawer structure manufactured according to an explanatory embodiment of the present invention. As explained more in detail in the following description, drawer structure 10 is intended to dispense metered amounts of at least one washing agent in a washing machine, in particular a laundry washing machine.

As you can see, drawer structure 10 is represented, by way of example, as built-in in a laundry washing machine M. Though, in further variants, this drawer structure can be applied to washing machines of different types, for example to a dishwasher.

Figure 1:
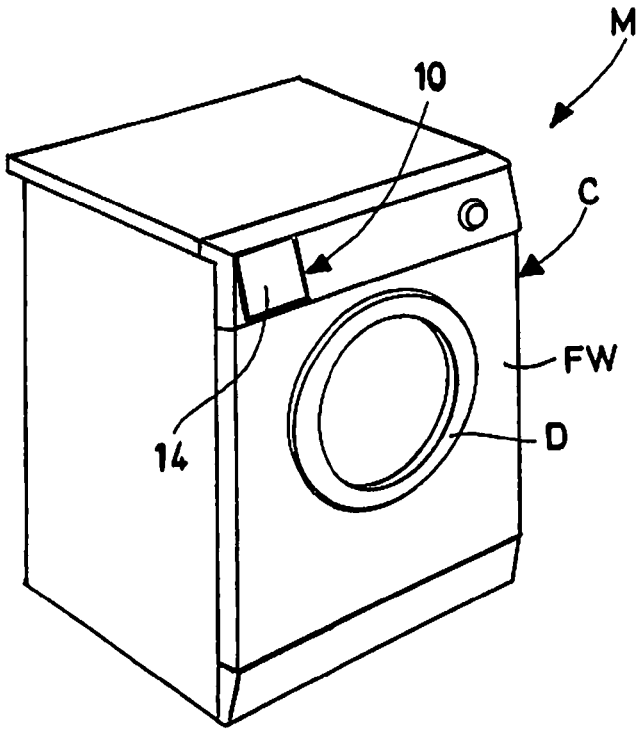
FIG. 1 is a schematic perspective view of a washing machine including a drawer structure manufactured according to an explanatory embodiment of the present invention.

In FIG. 1, laundry machine M has a casing C, in which there is defined a washing tank, in which a drum or basket is supported in a rotary manner so as to hold the clothes to be washed (details with no reference numbers). In particular, laundry washing machine M is, by way of example, a front-loading laundry machine having a loading opening, on which there is fitted a door D (optionally provided with a transparent window), which is hinged to a front wall FW of casing C and through which the clothes can be introduced into the drum. Though, the present invention can be equally applied also to laundry washing machines of different types, for example top-loading laundry washing machines, optionally provided with doors of different types.

In this embodiment, drawer structure 10 is fitted on the front face or wall FW of casing C of laundry washing machine M, for example arranged above the washing tank (and, thus, above door D). Though, as a person skilled in the art can easily understand, this arrangement of drawer structure 10 should not be interpreted as limiting for the scope of protection of the present invention.

With reference, in particular, to the figures from 2 to 4, drawer structure 10 comprises:

a hollow shell 12 or "drawer carrier", which is intended to be fitted on casing C of the washing machine M; and a drawer 14, which defines a pair of chambers 16*a*, 16*b*, each of which is suited to receive a washing agent, drawer 14 being mounted so as to move in shell 12 between an extracted position, in which each chamber 16*a*, 16*b* can be accessed through shell 12 and is ready to receive the washing agent, and a retracted position, in which each chamber 16*a*, 16*b* is closed by shell 12 and is suited to dispense said washing agent to the outside of structure 10.

In particular, the movement of drawer 14 in shell 12 takes place in a guided manner, for example as a translation movement in a direction that—in use—is substantially horizontal. Though, guided movements of different types can be provided, for example in the form of a rotation or oscillation of the drawer in shell 12.

In this embodiment, with reference, in particular, to the figures from 2 to 4, drawer 14 defines as a whole two chambers, in particular a laundry detergent chamber 16*a* and a fabric softener chamber 16*b*. Though, as a person skilled in the art can easily understand, in further embodiments the drawer can also define a single chamber or a number of chambers greater than two. In particular, with reference to FIG. 4, drawer 14 is shown represented from the back and with the rear delimiting wall represented in transparency, so as to clearly show the great number of components of structure 10.

As shown, for example, in FIGS. 3 and 4, structure 10 comprises, furthermore:

a pair of passages 17*a*, 17*b*, each of which is adapted to communicate, on one side, with a respective chamber 16*a*, 16*b* and, on the other side, with the outside of structure (in particular, towards the washing tank of laundry washing machine M), and a respective pair of pumping members 18*a*, 18*b*, each of which is suited to push a quantity of the washing agent contained in a respective chamber 16*a*, 16*b* through the respective passage 17*a*, 17*b* and, therefore, towards the outside of structure 10 (and, especially, towards the washing tank of laundry washing machine M).

Figure 2:
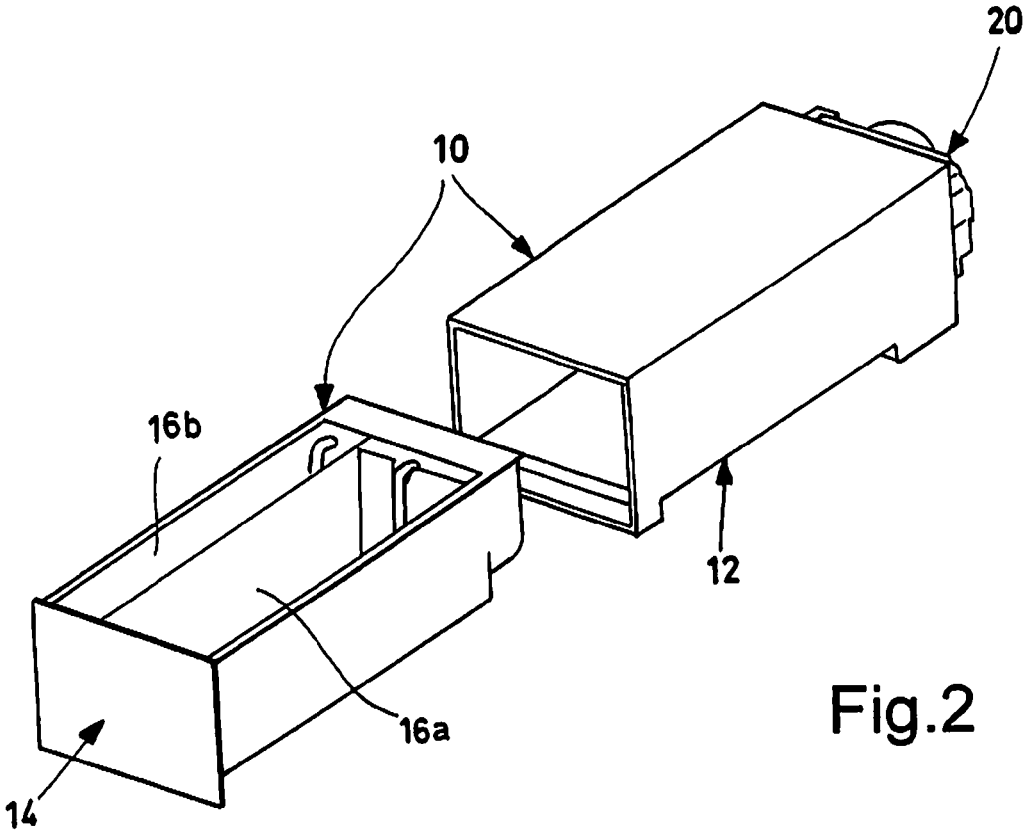
FIG. 2 is an exploded perspective view of the structure shown in FIG. 1.
Figure 7:
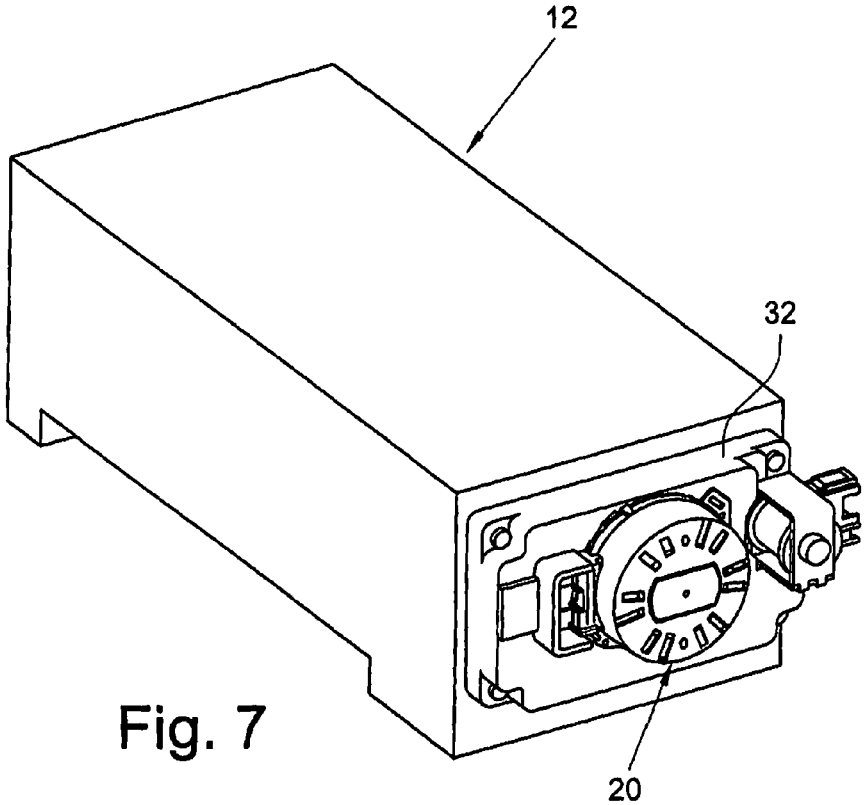
FIG. 7 is a rear perspective view of the shell shown in FIG. 6.
Figure 8:
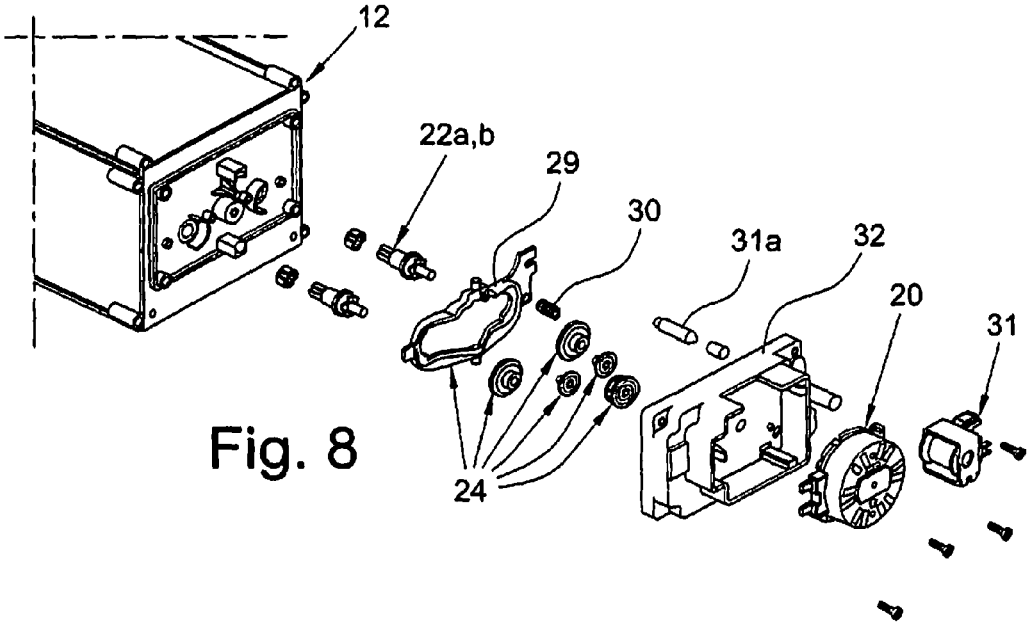
FIG. 8 is an exploded perspective view seen from the back of a part of the shell shown in FIGS. 6 and 7.
Figure 9:
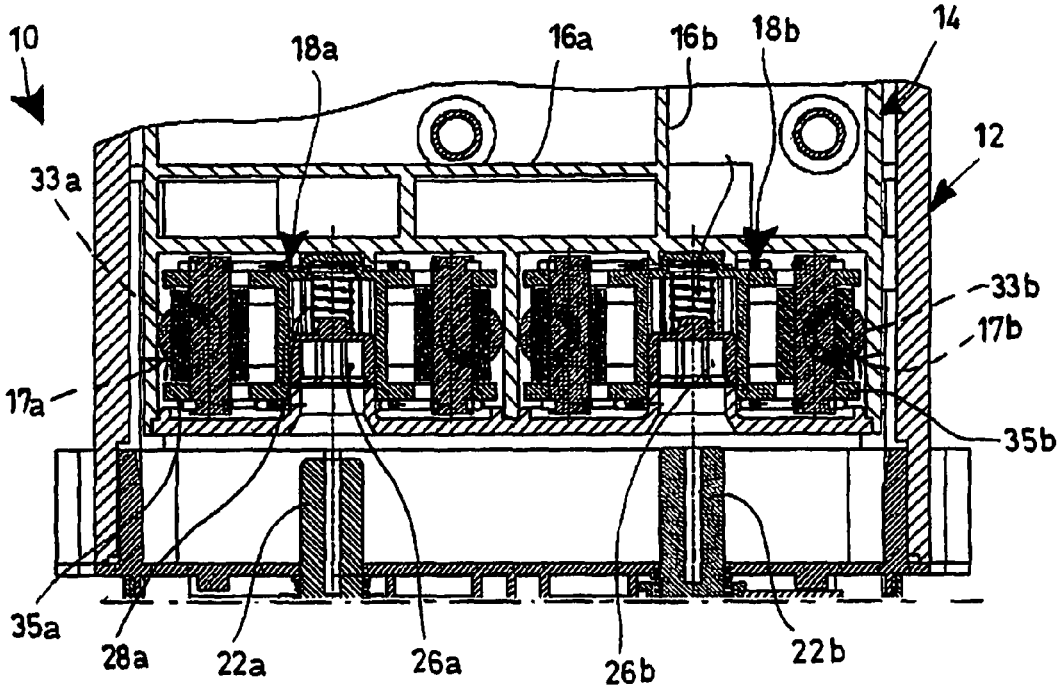
FIGS. 9 and 10 are partial longitudinal section views of the structure, in which portions of the drawer and of the shell shown in the previous figures are visible.

As shown, in particular, in FIGS. 2, 7 and 8, the structure comprises, furthermore, an electric motor 20, which is suited to operate pumping members 18*a*, 18*b* and is adapted to be connected to an electronic control unit of the washing machine.

As a person skilled in the art can easily understand, alternative embodiments are possible, in which the drawer has a single chamber and, in this case, only one passage and one pumping member are necessary. Vice versa, further embodiments are possible, in which a larger number of chambers are provided compared to the pair of chambers described with reference to the embodiment shown in the figures; even in this case a person skilled in the art is aware of the fact that, in order to adjust to these embodiments, a corresponding plurality of passages and associated pumping members must be provided.

Electric motor 20 is fixed on casing 12 and is separate from drawer 14. Furthermore, each pumping member 18*a*, 18*b* is able to assume an active condition, in which it is coupled to motor 20 and to respective passage 17*a*, 17*b*, thus allowing the aforesaid quantity of washing agent to be dispensed, when drawer 14 is in the retracted position, and an inactive condition, in which it is uncoupled from at least one between motor 20 and passage 17*a*, 17*b*, thus preventing the aforesaid quantity of washing agent from being dispensed, when drawer 14 is in the extracted position.

In this embodiment, in the inactive condition, pumping member 18*a*, 18*b* is uncoupled from motor 20.

In this way, structure 10 is able to ensure a safe and reliable electric connection between motor 20 and the electronic control unit. As a matter of fact, every time drawer 14 moves from the retracted position to the extracted position, this electric connection is substantially not affected. On the contrary, in this embodiment, the movement of drawer 14 between the retracted position and the extracted position simply implies a coupling and uncoupling, in particular of a mechanical nature, between motor 20 and pumping members 18*a*, 18*b*.

Besides, an electric insulation between drawer 14 and motor 20 is provided, since the electrically conductor elements of motor 20 are in a space that is separate and unaccessible relative to chambers 16*a*, 16*b* of drawer 14; this simultaneously implies that there is a greater space available in chambers 16*a*, 16*b*, so that they can house a larger quantity of washing agent (in this case, laundry detergent and/or softener).

Furthermore, the presence of a single removable constraint, preferably of a substantially mechanical nature, between motor 20 and pumping member 18 permits a simplified and ergonomic operating mode for a user who uses a laundry washing machine M provided with drawer structure 10, without the need to control, every time the machine is used, whether an electric connection/disconnection of motor 20 has actually taken place.

This removable constraint can be of different types, for example kinematic, dynamic (force-based), geometric (shape-based), so that, in the active condition, an electrically controlled operation of motor 20 corresponds to an associated rotation of desired pumping member 18*a*, 18*b*.

A further optional advantage that can be obtained with the present invention lies in the fact that drawer 14 can be completely extracted from the shell in a simple manner, for example for cleaning or washing operations to be performed on the drawer, without having to worry about preserving the integrity of possible connectors of electric contacts.

Always with reference to the embodiment shown, in particular, in the figures from 2 to 4, you can see that each pumping member 18*a*, 18*b* is mounted so as to be integral to drawer 14 during its movements between the retracted position and the extracted position. In particular, during the movement between the retracted and extracted position of drawer 14, each one of pumping members 18*a*, 18*b* remains coupled to the respective passage 17*a*, 17*b*, whereas the coupling and uncoupling take place between corresponding pumping member 18 and motor 20.

With reference, in particular, to FIGS. 5, 6, 9 and 10, we are going to describe a preferred way in which each pumping member 18*a*, 18*b* can be coupled to motor 20. In this embodiment, there is a single motor 20, which is provided with a pair of output shafts 22*a*, 22*b* and with an appropriate transmission mechanism 24, adapted to selectively control the power delivered by output shafts 22*a*, 22*b*. Each one of output shafts 22*a*, 22*b* is adapted to be inserted into a corresponding seat 26*a*, 26*b*, which is obtained in respective mobile pumping member 18*a*, 18*b*. In particular, each output shaft 22*a*, 22*b* has a shaped section (for example with a multi-lobed shape or a star shape), adapted to engage seat 26*a*, 26*b* with a corresponding shape, when drawer 14 moves to the retracted position.

In this embodiment, the coupling between each output shaft 22*a*, 22*b* and respective seat 26*a*, 26*b* is adapted to take place in a dampened manner. Preferably, each seat 26*a*, 26*b* is torsionally supported, in particular thanks to a respective elastic member 28*a*, 28*b*, by the respective mobile pumping member 18*a*, 18*b*. In this way, in particular thanks to the above-mentioned torsional clearance, the coupling between each output shaft 22*a*, 22*b* and respective seat 26*a*, 26*b* becomes easier, even if their complementary shapes are not perfectly aligned when drawer 14 is pushed to the retracted position.

In the embodiment shown, each seat 26*a*, 26*b* is obtained on a cup-shaped element (with a shape that is complementary to the one of respective output shaft 22*a*, 22*b*), which is housed in a turning manner and can be rotated in the central position of mobile member 18*a*, 18*b* in a torsionally constrained manner, in particular by means of elastic member 28*a*, 28*b* (for example a properly pre-loaded helical spring).

In the embodiment shown, a single motor 20 is provided to selectively control each output shaft 22*a*, 22*b* by means of transmission mechanism 24, in particular of the clutch type. More in detail, transmission mechanism 24 can be engaged by means of an electric command, so as to selectively activate, one at a time, the desired output shaft 22*a*, 22*b*. In particular, transmission mechanism 24 comprises an oscillating lever 29, which tends to elastically hold (see, for example spring 30 acting upon said lever 29), in a engaging or meshing manner, an output shaft 22*a* with electric motor 20 and is adapted to be moved so as to engage or mesh with the other output shaft 22*b* due to the action of an electromagnetic actuator 31, which is suited to be electrically supplied with power by the electronic control unit of the laundry washing machine and is designed to push oscillating lever 29. The activation of electromagnetic actuator 31 causes an oscillation of oscillating lever 29, in particular having the shape of a rocker arm, which brings the gear clutch to a condition such as that output shaft 22*b* meshes with the motor. Vice versa, upon deactivation of electromagnetic actuator 31, spring 30 tends to bring oscillating lever 29 back to a position in which it is arranged so as to mesh with output shaft 22*a*.

In the embodiment shown, oscillating lever 29 comprises a rocker arm, which is hinged to shell 12, for example about a substantially vertical rotation axis. Rotation axis 29 preferably intersects the rotation axis of electric motor 20, which means that it substantially is in a central and intermediate position between the two output shafts 22*a*, 22*b*.

In the embodiment shown, electromagnetic actuator 31 comprises a ferromagnetic core 31*a*, which can be excited by a solenoid (not shown), which is connected to an arm 29*b* of the rocker arm offered by oscillating lever 29. In particular, ferromagnetic core 31*a* is constrained to arm 29*b*, which is pushed by spring 30, whereas the associated solenoid is able to attract ferromagnetic core 31*a* when it is excited by an electric current. In this way, ferromagnetic core 31*a* is able to cause arm 29*b* to lower against the action of spring 30, thus causing transmission mechanism 24 to engage output shaft 22*b* and, at the same time, raising opposite arm 29*a* (which, in turn, disengages transmission mechanism 24 from output shaft 22*a*).

Preferably, transmission mechanism 24 comprises a plurality of gears (with no reference numbers), which cooperate with single motor 20 so as to allow motion to be transferred to output shafts 22*a*, 22*b* in a manner that is appropriate to provide the necessary power to pumping members 18*a*, 18*b*.

Preferably, each one of passages 17*a*, 17*b* comprises a deformable tube 33*a*, 33*b* and each pumping member 18*a*, 18*b* comprises a peristaltic rotor 35*a*, 35*b*, adapted to hydraulically cooperate with respective deformable tube 33*a*, 33*b* so as to push the washing agent contained in corresponding chamber 16*a*, 16*b*.

In the embodiment shown, peristaltic rotor 35*a*, 35*b* comprises a pair of projecting portions (with no reference numbers), which are preferably arranged on diametrically opposite sides adapted to be arranged in contact with the walls of deformable tube 33*a*, 33*b*. In particular, these projecting portions are adapted to create a local narrowing obtained on deformable tube 33*a*, 33*b*, and adapted to cause the fluid contained therein to move forward during the rotation of peristaltic rotor 35*a*, 35*b*. Preferably, at least one of these projecting portions comprises a peripheral roller, capable of locally compressing deformable tube 33*a*, 33*b*, thus generating a consequent narrowing on the latter.

In particular, in this embodiment, each seat 26*a* 26*b* is preferably obtained on a cup-shaped element, which is housed and able to rotate (in a torsionally constrained manner) in a substantially central position of the associated peristaltic rotor 35*a*, 35*b*.

In this embodiment, each one of passages 17*a*, 17*b* comprises a respective duct 37*a*, 37*b*, preferably substantially rigid, which is adapted to suck the fluid from the bottom of corresponding chamber 16*a*, 16*b* and communicates with the inlet of associated deformable tube 33*a*, 33*b*. In particular, each duct 37*a*, 37*b* is substantially L-shaped, since it preferably starts, with an ascending segment, from the bottom of associated chamber 16*a*, 16*b* and ends in a substantially horizontal segment, thus joining deformable tube 33*a*, 33*b*.

In this embodiment, each pumping member 18*a*, 18*b* (in particular, each peristaltic rotor 35*a*, 35*b*) can rotate about a horizontal rotation axis.

In this embodiment, motor 20 is mounted in correspondence to rear wall 32 of shell 12, in particular on the outer face thereof. More in detail, each one of output shafts 22*a*, 22*b* projects towards the inner cavity of shell 12, thus extending through rear wall 32.

Figure 5:
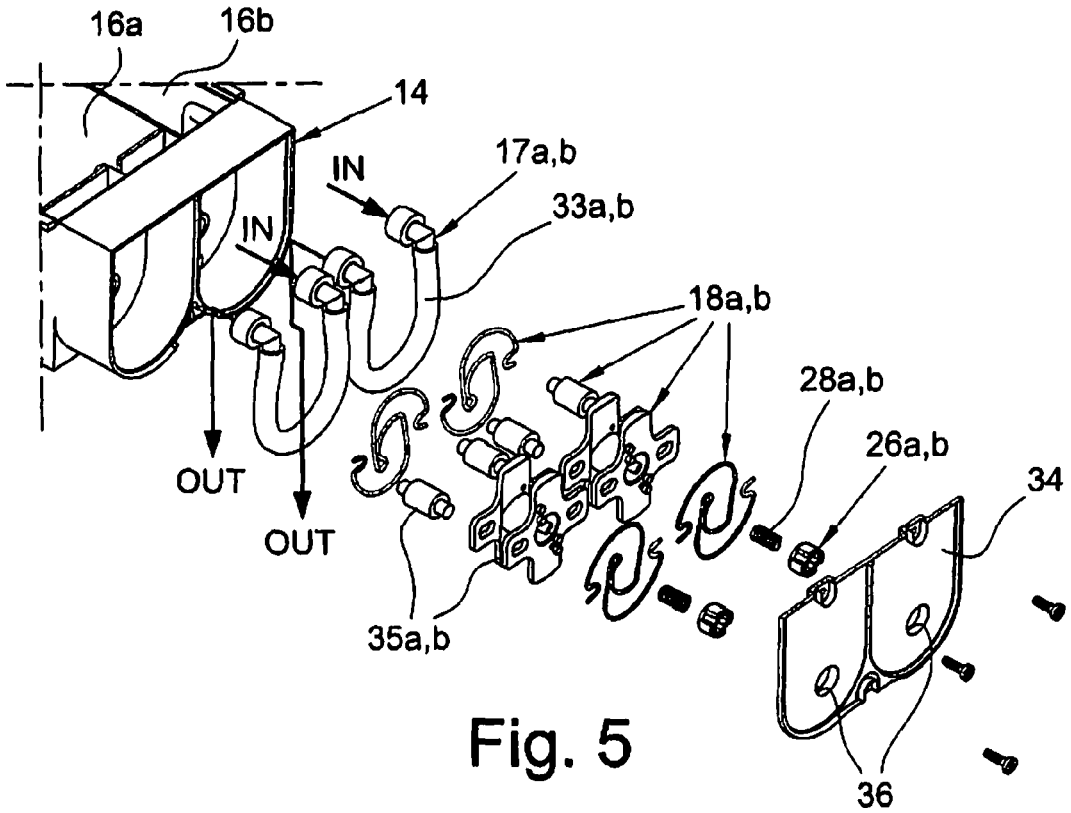
FIG. 5 is an exploded perspective view seen from the back of a part of the drawer shown in FIGS. 3 and 4.
Figure 6:
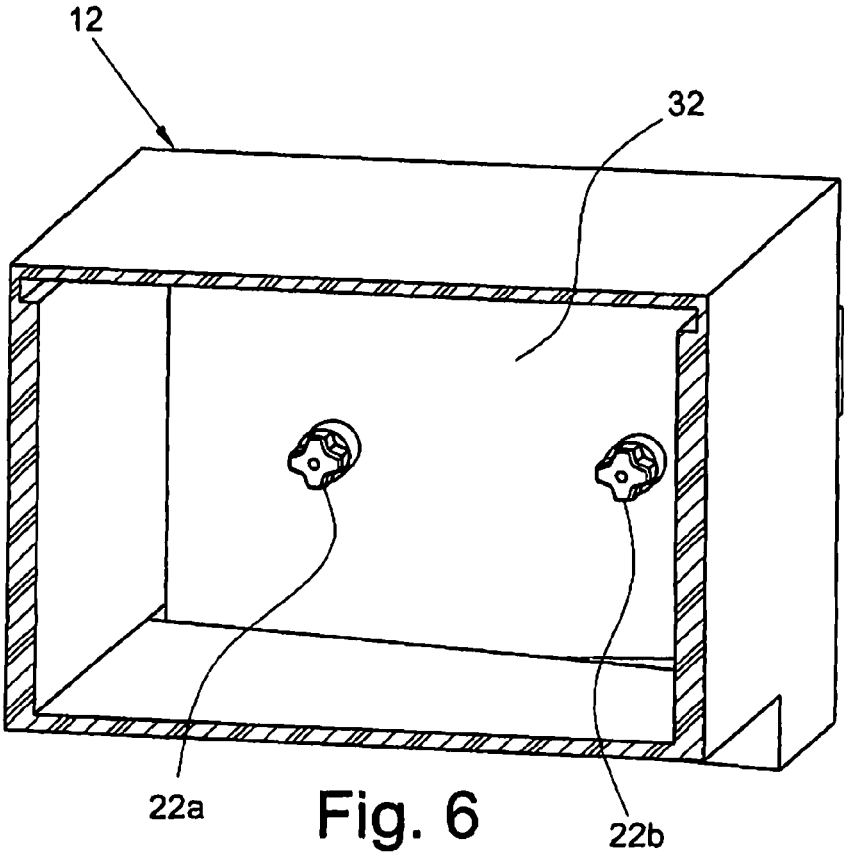
FIG. 6 is a front perspective view of a part of a shell of the structure shown, in particular, in FIG. 2.

In this embodiment, with reference, in particular, to FIG. 5, pumping members 18*a*, 18*b* (in particular, peristaltic rotors 35*a*, 35*b*) and respective passages 17*a*, 17*b* (in particular, deformable tubes 33*a*, 33*b*) associated therewith are enclosed, on the rear side, in drawer 14, in particular by a rear wall 34. Preferably, rear wall 34 has a pair of openings 36, through which output shafts 22*a*, 22*b* are able to be coupled to pumping members 18*a*, 18*b*, in particular in correspondence to seats 26*a*, 26*b*.

In the embodiment shown, with reference, in particular, to FIG. 3, each passage 17*a*, 17*b* is adapted to drain the quantity of washing agent drawn from associated chamber 16*a*, 16*b* through an intermediate hollow space 38, which is obtained in drawer 14 and communicates with the outside through proper openings, which are obtained, for example, on the bottom of shell 12 (details not visible), when drawer 14 is in the retracted position. In particular, intermediate hollow space 38 is delimited by partitions or dividing walls (with no reference numbers), which are arranged between chambers 16*a*, 16*b* and pumping members 18*a*, 18*b*.

With reference to the FIG. 11, number 110 indicates, as a whole, a drawer structure manufactured according to a further explanatory embodiment of the present invention.

Details and elements that are similar to those of the embodiment described above—or fulfill a similar function—are associated with the same alphanumeric references. For the sake of brevity, the description of these details and elements will not be repeated below, but reference is made to what was previously explained in the description of the first embodiment.

Unlike the embodiment described in the previous figures, structure 110 comprises a pair of motors 120*a*, 120*b*, which are independent of one another and are fitted on shell 12. In this way, in order to operate each pumping member 18*a*, 18*b* so that it pushes the washing agent contained in the respective chamber 16*a*, 16*b*, the corresponding motor 120*a*, 120*b* simply needs to be electrically activated in a selective manner. In this case, each motor 120*a*, 120*b* controls the rotation of the respective output shaft 22*a*, 22*b*. Therefore, the presence of the clutch transmission mechanism 24 to alternately transfer motion to pumping members 18*a*, 18 is avoided.

The other features concerning the embodiment shown in FIG. 11 are substantially the same as the ones described in the embodiment shown in the figures from 1 to 10; therefore, for the sake of brevity, they will not be repeated below, but reference is made to the paragraphs of the description above.

With reference to the figures from 12 to 14, number 210 indicates, as a whole, a drawer structure manufactured according to another explanatory embodiment of the present invention.

Details and elements that are similar to those of the embodiment described above—or fulfill a similar function—are associated with the same alphanumeric references. For the sake of brevity, the description of these details and elements will not be repeated below, but reference is made to what was previously explained in the description of the previous embodiments.

Figure 10:
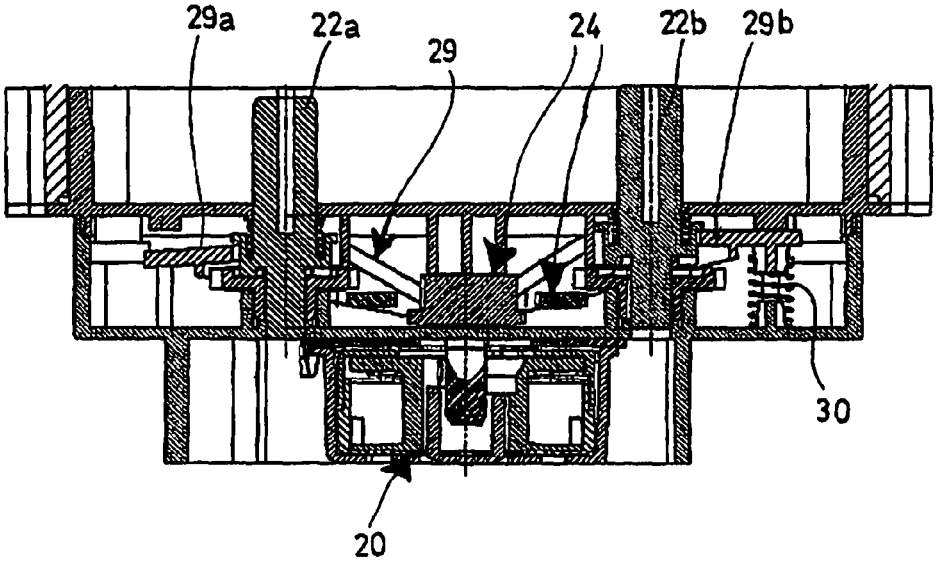
Figure 13:
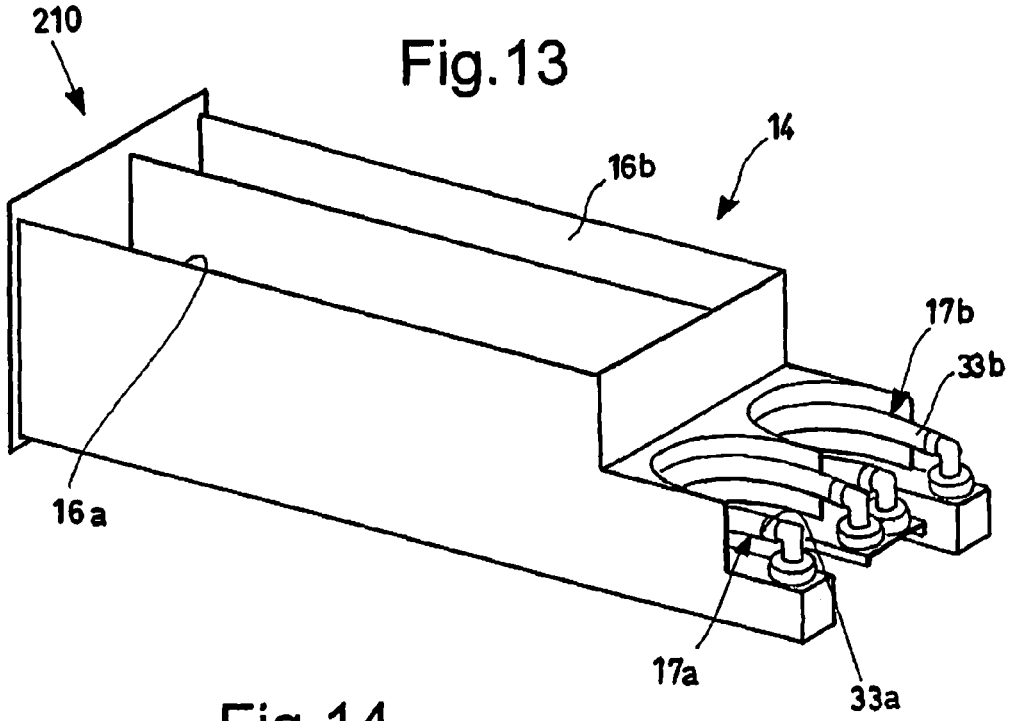
FIG. 13 is a rear perspective view of a drawer of the structure shown in FIG. 12.
Figure 14:
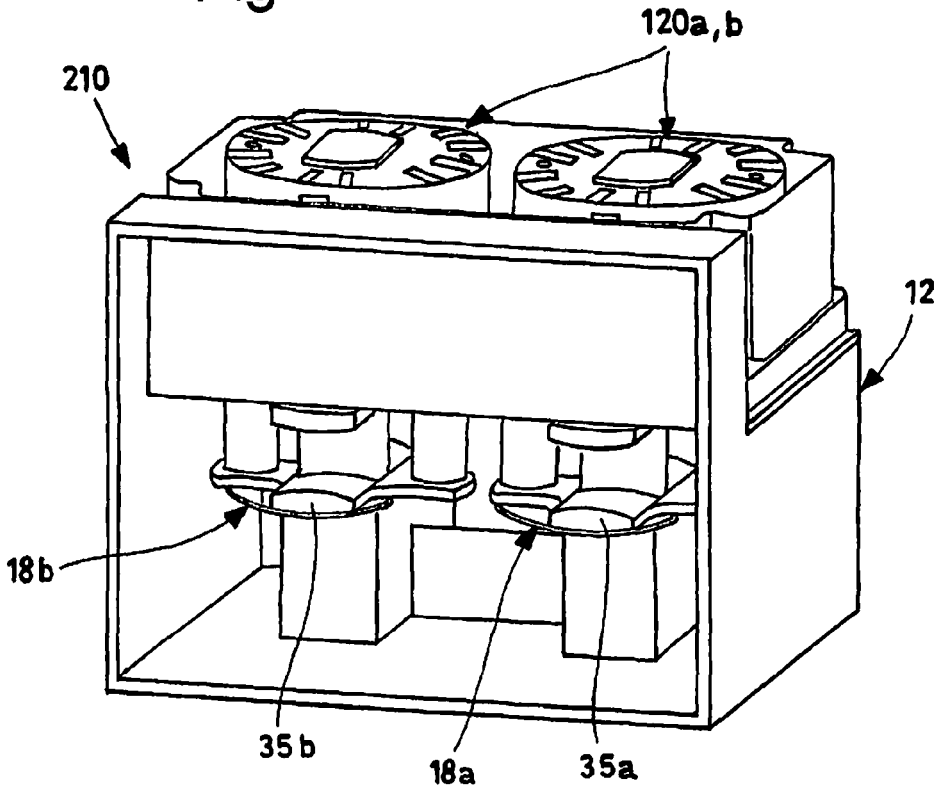
FIG. 14 is a front perspective view of a part of the shell shown in FIG. 12.

Similarly to the embodiment shown in FIG. 10, this embodiment preferably—but not necessarily—comprises a structure with two motors 120*a*, 120*b*, each of which separately and independently controls the output shafts (in this case without reference numbers). Actually, the single-motor structure described with reference to the embodiment shown in the figures from 1 to 9 could also be applied, thus providing a transmission mechanism, which is adapted to selectively transfer motion from the motor to one or the other output shaft in an alternative manner.

Unlike the embodiments described above, when drawer 14 is in the extracted position, each pumping member 18*a*, 18*b* is in the inactive condition, in which it is uncoupled from respective passage 17*a*, 17*b*, thus preventing a quantity of washing agent from being dispensed.

To sum up, in this embodiment, the movement of drawer between the retracted position and the extracted position simply implies a coupling and uncoupling of a substantial hydraulic nature between pumping members 18*a*, 18*b* and respective passages 17*a*, 17*b*.

In other words, in the active condition, by (hydraulic) coupling between each pumping member 18*a*, 18*b* and respective passage 17*a*, 17*b* we mean a mutual arrangement thereof that is able to deliver energy to the fluid capable of flowing through passage 17*a*, 17*b* during the activation of the motor 20*a*, 20*b*. In this way, we obtain a hydraulic cooperation that is adapted to exert a head upon the fluid so as to cause it to be drawn from associated chamber 16*a*, 16*b* and transferred to the outside through passage 17*a*, 17*b*.

In this embodiment, the aforesaid hydraulic cooperation takes place by means of the narrowing, which is provoked by each peristaltic rotor 35*a*, 35*b* on respective deformable tube 33*a*, 33*b*, for example on diametrically opposite sides of peristaltic rotor 35*a*, 35*b*, during the rotation exerted by motor 20*a*, 20*b*.

Similarly, in the inactive condition, by (hydraulic) uncoupling between each pumping member 18*a*, 18*b* and respective passage 17*a*, 17*b* we mean a mutual arrangement thereof that is able to separate them and pull them apart. In particular, this mutual arrangement is nor able to deliver energy to the fluid capable of flowing through passage 17*a*, 17*b* during the activation of motor 20*a*, 20*b*. In this way, there is no hydraulic cooperation between passage 17*a*, 17*b* and relative pumping member 18*a*, 18*b* and, therefore, no head is exerted upon the aforesaid fluid so as to cause it to be drawn from associated chamber 16*a*, 16*b* and transferred to the outside through passage 17*a*, 17*b*.

In this embodiment, in the condition in which each passage 17*a*, 17*b* and respective pumping member 18*a*, 18*b* are uncoupled, the above-mentioned mutual arrangement takes place by detaching and pulling apart peristaltic rotor 35*a*, 35*b* from the contact with respective deformable tube 33*a*, 33*b*. In this way, during the rotation caused by motor 20*a*, 20*b*, peristaltic rotor 35*a*, 35*b*, despite being able to rotate, cannot act upon deformable tube 33*a*, 33*b*, since it is detached and not in contact on it any longer.

Preferably, each pumping member 18*a*, 18*b* is mounted at the output of respective motor 20*a*, 20*b*, in particular being steadily coupled—for example fitted flush—to the respective output shaft of said motor (without reference number).

Therefore, each pumping member 18*a*, 18*b*—when drawer 14 moves to the retracted position—is caused to cooperate with respective passage 17*a*, 17*b*, which, even in this case, is integral to drawer 14 and, hence, close to respective pumping member 18*a*, 18*b*.

In this embodiment, in the active condition, each deformable tube 33*a*, 33*b* belonging to passage 17*a*, 17*b* is compressed against peristaltic rotor 35*a*, 35*b* created by pumping member 18*a*, 18*b*. In particular, each deformable tube 33*a*, 33*b* defines a cove, whose convexity horizontally faces peristaltic rotor 35*a*, 35*b* created by pumping member 18*a*, 18*b*. On the contrary, in the embodiment shown in the figures from 1 to 10, the cove defined by deformable tube 33*a*, 33*b* vertically faces peristaltic rotor 35*a*, 35*b*.

In this embodiment, each pumping member 18*a*, 18*b* (in particular, peristaltic rotor 35*a*, 35*b*) is mounted so as to rotate about a substantially vertical axis, which preferably coincides with the rotation axis of the output shaft of respective motor 20*a*, 20*b*.

If possible, the technical features differentiating the different versions of the embodiments described and illustrated above can freely be exchanged among said versions and embodiments.

Naturally, the principle of the present invention being set forth, the embodiments and the implementation details can be widely changed relative to what described above and shown in the drawings as a mere way of non-limiting example.

For example, in further embodiments of the invention, the combination of passage 17*a*, 17*b* and pumping member 18*a*, 18*b* can be different from the peristaltic pump structure (including deformable tube 33*a*, 33*b* and peristaltic rotor 35*a*, 35*b*) suggested in the embodiments shown in the figures. In particular, the passage and the pumping member can be manufactured so as to create, on the overall, pump structures of different types, such as, by way of example, gear pumps, blade pumps, lobe pumps, screw pumps, etc.

Furthermore, in the embodiments shown, we discussed the use of a motor 20 or a plurality of motors 20*a*, 20*b*. In particular, for this motor or these motors, reference was made to apparatus that deliver, as an output, a rotary motion, for example by means of one or more output shafts. Though, as a person skilled in the art can easily understand, the aforesaid motors can be replaced or even combined with an actuator that is capable of delivering, as an output, a non-rotary motion (for example a translation motion) by means of a respective output member and can be coupled in an appropriate manner to one or more pumping members 18*a*, 18*b*, by means of suitable technical solutions. Therefore, according to the present invention, the drawer structure is compatible with any kind of moving means, including a motor and/or an actuator, which—at least in the active condition—are suited to control one or more pumping members.

The invention claimed is:

1. A drawer structure for dispensing metered amounts of at least one washing agent in a washing machine, said structure comprising:

a hollow shell fitted on a casing of said washing machine;

a drawer defining at least one chamber for receiving a washing agent and mounted to move in said shell between an extracted position, in which said at least one chamber is accessible from outside of said structure and is ready to receive said washing agent, and a retracted position, in which said at least one chamber is closed by said shell and arranged for dispensing said washing agent to the outside of said structure;

at least one passage which communicates, on one side, with said at least one chamber and, on an other side, with the outside of said structure;

at least one pumping member arranged for driving a quantity of said washing agent from said at least one chamber through said passage; and at least one actuator or electric motor arranged for operating said at least one pumping member and for being connected to an electronic control unit of said washing machine;

wherein said at least one actuator or motor is fixed on said shell and is separate from said drawer, and said at least one pumping member is able to assume:

an active condition, in which said pumping member is coupled to said at least one actuator or motor and to said at least one passage, allowing said quantity of washing agent to be dispensed, when said drawer is in said retracted position, and an inactive condition, in which said pumping member is uncoupled from at least one between said at least one actuator or motor and said at least one passage, preventing said quantity of washing agent from being dispensed, when said drawer is in said extracted position;

said structure further comprising:

a plurality of said chambers, a plurality of said passages, each one of said passages being associated with a respective chamber, and a plurality of pumping members, each one of said pumping members being hydraulically coupled to a respective passage;

said structure comprising a single actuator or motor which, in turn, comprises a plurality of output members and a transmission mechanism arranged for selectively controlling the power delivered by the output members to the respective pumping members;

wherein said transmission mechanism is a clutch type mechanism and is fit for selectively activating said output members in an electrically controlled manner; and wherein said transmission mechanism comprises an oscillating lever which is elastically engageable with an output shaft with said single electric motor; said oscillating lever being adapted to be moved to engage an other output shaft due to action of an electromagnetic actuator, which is suited to be electrically supplied with power by said electronic control unit of the washing machine and is designed to push said oscillating lever.

2. A structure according to claim 1, wherein said oscillating lever comprises a rocker arm hinged to said shell.

3. A structure according to claim 1, wherein, in said inactive condition, said at least one pumping member is mechanically uncoupled from said at least one actuator or motor.

4. A structure according to claim 3, wherein, in said inactive condition and in said active condition, said at least one pumping member remains hydraulically coupled to said at least one passage.

5. A structure according to claim 3, wherein said at least one pumping member is mounted to move as a unit with said drawer during movement between said retracted position and said extracted position.

6. A structure according to claim 3, wherein each output member has a shaped section adapted to engage seat with a corresponding shape, when said drawer moves to the retracted position; each seat being torsionally supported by the respective pumping member, so that the coupling between each output member and respective seat takes place in a dampened manner.

7. A structure according to claim 6, wherein each seat is torsionally supported, through a respective elastic member, by the respective pumping member.

8. A structure according to claim 1, wherein, in said inactive condition, said at least one pumping member is hydraulically uncoupled from said at least one passage.

9. A structure according to claim 8, wherein, in said inactive condition and in said active condition, said at least one pumping member remains mechanically coupled to said at least one actuator or motor.

10. A structure according to claim 8, wherein said at least one pumping member is mounted at the output of said at least one actuator or motor.

11. A structure according to claim 1, wherein said at least one passage comprises a deformable tube and said at least one pumping member is a peristaltic rotor, for hydraulically cooperating with said deformable tube to drive the washing agent contained in the corresponding chamber.

12. A structure according to claim 1, wherein said at least one pumping member is rotatable about a horizontal rotation axis.

13. A structure according to claim 1, wherein said at least one pumping member is rotatable about a vertical axis.

* * * * *